US007238279B2

(12) United States Patent
Saurenman et al.

(10) Patent No.: US 7,238,279 B2
(45) Date of Patent: Jul. 3, 2007

(54) IMPULSE-RESPONSIVE ROTARY ACTUATOR FOR STORM DRAIN BARRIER NOT DISABLED BY IMMERSION

(76) Inventors: Donald Alexander Saurenman, 1433 Adelia Ave., El Monte, CA (US) 91733; J. Anthony Baird, 3525 N. Ave. Montuoso, Thousand Oaks, CA (US) 91362

( * ) Notice: Subject to any disclaimer, the term of this patent is extended or adjusted under 35 U.S.C. 154(b) by 0 days.

(21) Appl. No.: 11/155,329

(22) Filed: Jun. 16, 2005

(65) Prior Publication Data

US 2006/0285926 A1 Dec. 21, 2006

(51) Int. Cl.
*E03F 5/06* (2006.01)

(52) U.S. Cl. ..... 210/131; 210/121; 210/163

(58) Field of Classification Search ..... 210/121, 210/131, 163; 404/4
See application file for complete search history.

(56) References Cited

U.S. PATENT DOCUMENTS

| | | | | |
|---|---|---|---|---|
| 4,225,434 | A * | 9/1980 | Ernst et al. | 210/98 |
| 6,217,756 | B1 | 4/2001 | Martinez | |
| 6,726,402 | B1 | 4/2004 | Martinez | |
| 6,821,053 | B2 * | 11/2004 | Martinez | 405/40 |
| 6,824,677 | B2 | 11/2004 | Martinez | |
| 6,869,523 | B2 | 3/2005 | Martinez | |

* cited by examiner

*Primary Examiner*—Sunil Singh
(74) *Attorney, Agent, or Firm*—Donald D. Mon

(57) ABSTRACT

A pivoted gate across an opening from a gutter into a collector basin. An actuator inside the basin is insensitive to slow flow rates, but includes a rotor with vanes that actuate an opening linkage at sufficiently high rates of flow. A float is included in the actuator to exert a gate-opening torque when the rotor is flooded.

4 Claims, 4 Drawing Sheets

IMPULSE-RESPONSIVE ROTARY ACTUATOR FOR STORM DRAIN BARRIER NOT DISABLED BY IMMERSION

FIELD OF THE INVENTION

Exclusion of debris and trash from gutters and storm drains except during high rates of stream flow, and assured opening of the system under flooded conditions.

BACKGROUND OF THE INVENTION

Gutters and storm drains are commonly placed alongside roadways to drain casual water and storm water into a collection system leading to treatment plants and then to places of ultimate disposition such as oceans, rivers and spreading grounds. A drain opening when open accepts not only the water but also solid material such as trash and debris which falls or is placed in the roadway. For convenience, this material is collectively referred to as "trash".

During intervals between rains, municipalities and their service organizations generally attempt to collect trash by mechanical means such as sweepers, and to clean out drain basins manually and with vacuums. The purpose is to clear the drainage system to keep it in readiness for the next rain. A persistent problem is that these measures are not always available in time to keep all of the trash in the street. Even sweepers may deflect much of it into the drain.

This situation has long been recognized and installations have been made to prevent it. Examples are shown in Martinez U.S. Pat. Nos. 6,217,756, 6,824,677, and 6,869,523. In these devices, a hinged gate is placed in the opening into the drain. At slow rates of flow, water gradually drains, even drips, into the basin through a perforated gate or a gap next to the gate. But the gate remains closed to trash.

However, when the flow of water reaches a sufficiently high rate, such as in a storm, an actuator responsive to the stream flow will open the gate and admit the entire flow. This may be accompanied by some trash, but that is inevitable. The drain system is still functional.

Known systems to exclude trash in drier modes commonly include an actuator to open a gate which is somehow responsive to the rate of flow of the water. In the U.S. Pat. Nos. 6,217,756 and 6,869,523 Martinez patents, the weight of water in a bucket which leaks or tilts is used as the actuator (or more precisely the sensor). In Martinez U.S. Pat. No. 6,821,053 it is a rotary actuator responsive to the impact force of the stream, an impulse-type reaction.

A pervasive problem with systems of these types which must inherently be installed in the basin, is that they are disabled unless they are free for actuation by collecting and retaining a sufficient volume of water for a given period of time, or is available to be directly struck by the entering stream. A "leaky bucket" cannot "leak" when it is totally submerged. A rotor actuated by stream force cannot react to a stream when it is totally submerged. As a result in either case the gate could possibly close at the worst possible time (during very heavy stream flow), resulting in upstream flooding.

This problem was recognized in the U.S. Pat. No. 6,821,053 Martinez patent, in which a latch, moved by a float, is intended to hold the gate open when the actuator is flooded. This presents the issue of uncertainty when the "powering system" (the sensor) operates independently of water level-responsive latches.

It is an object of this invention, utilizing an impulse-type rotary actuator, to include a secondary opening force into the system exerted by a buoyant float directly connected to the rotary actuator which tends to apply an opening torque to the rotor that will maintain the gate open when the rotary actuator itself is flooded. There results a system that is proof against being disabled by flooding due to excessive flow rates or by plugged-up downstream systems.

BRIEF DESCRIPTION OF THE INVENTION

The actuator according to this invention is intended to be incorporated into a system which is installed in a drainage basin adjacent to an entry opening from a source of drainage or storm water, like a curb for example. It includes a pivoted gate intended to remain closed when the rate of water flow is suitably slow, and to be opened when the water flow exceeds that rate. A linkage is provided between the actuator and the gate to effect this objective.

The actuator itself is a rotor that includes at least one vane. The vane or vanes is or are so disposed and arranged as to be impacted by water which has passed the gate at higher stream rates, but not at slower stream rates. The resulting impulse force (the vane can drain) will cause the rotor to rotate in a first direction to cause the linkage to open the gate and this condition will continue so long as the rate is sufficiently high and the vane is not submerged. When the flow rate decreases sufficiently, the weight of the gate and the linkage will cause the rotor to reverse its direction and the gate will close.

This situation can prevail while the rotor remains exposed to the stream. However, if somehow the rotor becomes submerged, this effect is masked. For example if the downstream drainage system is plugged and the basin fills above the rotor, the rotor will not receive an actuating water stream and the gate would close. According to this invention, to prevent this event, a buoyant float is linked to (and preferably is directly attached to) the rotor at the side of the rotor opposite from the vanes, whereby when submerged it will exert on the rotor a torque in the same sense as the stream flow did. Thus there will persist a torque that will maintain the gate open so long as the basin is flooded.

This invention contemplates the actuator itself, and also the actuator in combination with the system installed in a basin.

The above and other features of this invention will be fully understood from the following detailed description and the accompanying drawings, in which:

DETAILED DESCRIPTION OF THE INVENTION

Figure 1:
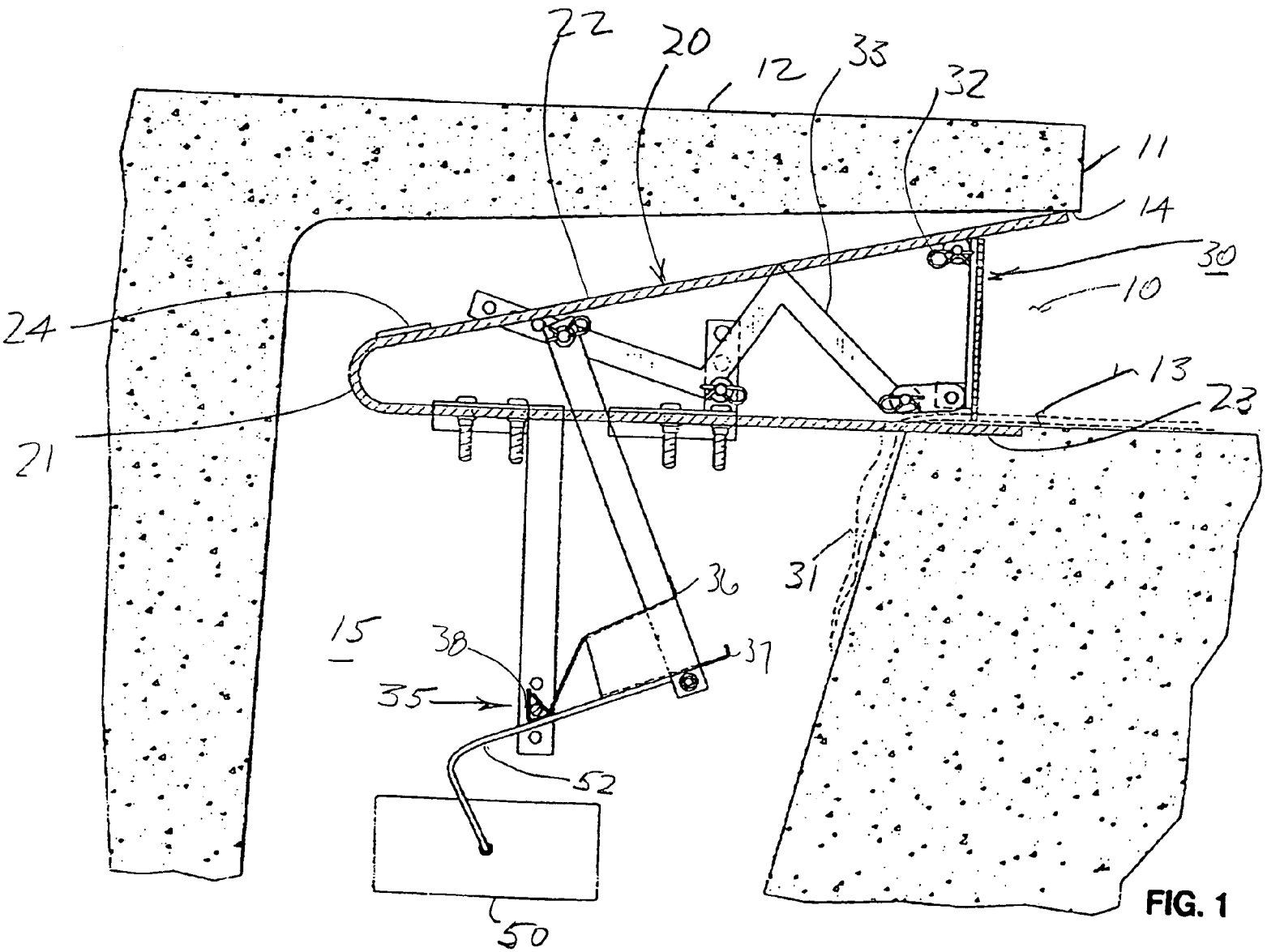
FIG. 1 is a side elevation partly in axial cross-section showing the preferred embodiment of the invention in its closed condition, experiencing slow flow.

An opening 10 from a gutter is through a curb 11 is shown in FIG. 1. It has a bottom sill 13 a top 14 and two sides (not shown) to provide a rectangular aperture leading into a drainage basin 15 into which water drained from the gutter will flow, and will thereafter be passed to a downstream disposal system. A sidewalk 12 or other covering structure is shown, which may be provided with access mean such as a manhole.

A frame 20, includes a pair of U-shaped springy identical and spaced apart rigid metal straps (only strap 21 being shown). Arm 22 engages the underside of the opening. Arm 23 engages the sill. When properly attached, these straps, joined by a transverse plate 24, will support the system in the basin.

A gate 30, when closed, extends across opening 10. As preferred it may be perforated, or may have a portion of its periphery spaced from the side or the sides of the opening to form a gap that permits water presented at slow rates to proceed past the closed gate. These dimensions are such as to stop most trash. At slow rates the water 31 merely dribbles down the side wall of the basin, and does not affect the actuator, as will be described. This will attend to periods of light rain, or merely the runoff from lawn watering or car washing. Trash will be retained.

As shown in FIG. 1, gate 30 is hinged by hinge 32 so it can swing upwardly and inwardly. A linkage 33 is responsive to the rotary position of an actuator 35 pivotally attached to the frame below the level of the sill and spaced from it.

The details of the linkage are unimportant and obvious. Any crank type system that transfers torque from a rotor to a hinged gate will suffice.

Figure 4:
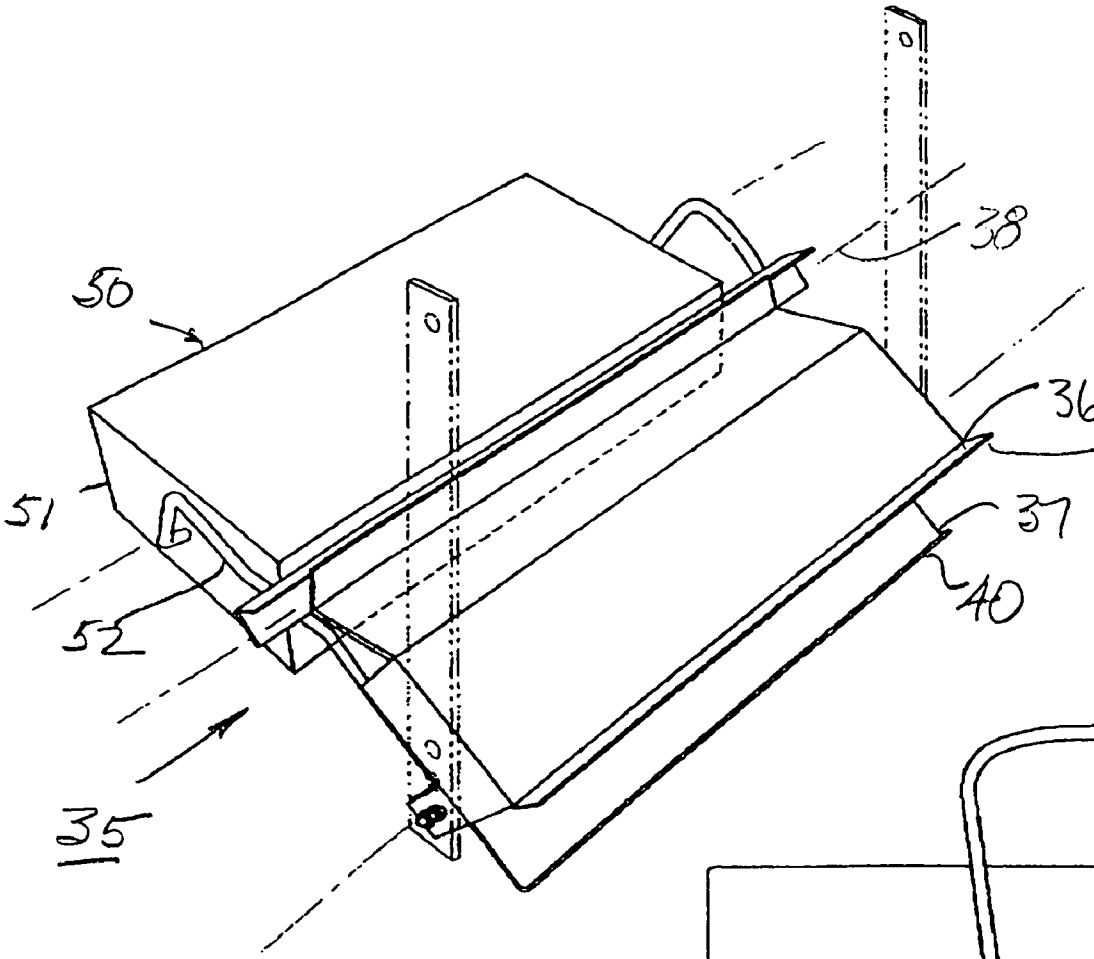
FIG. 4 is a perspective view the actuator.

The actuator includes at least one, but preferably two vanes 36, 37 spaced from pivot 38. As shown in FIG. 4, each vane has a respective flange 39, 40 and open side edges. In the repose condition of FIG. 1 flange 37 is the closer to the wall of the basin, spaced far enough from that wall so that slow flow 31 will by-pass the actuator completely and the gate will remain closed. Also, assuming that the basin is not plugged up and dry, there will be no reaction with water at all. The inherent bias of the system, starting with the weight of the gate and the linkage is to keep the gate closed.

In order to open the gate, a positive torque shown by arrow 45 (FIG. 2) must be exerted. This will start to occur when water flow 46 (FIG. 2) becomes so fast that a stream reaches and impacts the vanes. The impulse of this stream will drive the vanes in the direction of arrow 45, opening the gate. As the rate increases there will be increased force, fully to open the gate (FIG. 3). This is the subject of Martinez U.S. Pat. No. 6,821,053, which is incorporated herein by reference in its entirety for its showing of such a system. This assumes that the basin is entirely drained at least to a level below the rotor.

However, assume now that the rate of flow exceeds the capacity of the downstream opening, or the downstream system is plugged. Then the rotor would be flooded as suggested by wavy line 48. Without additional features the gate would simply close.

To avert this, a buoyant float 50 is attached to the rotor in such a way that when in water its buoyant force will be exerted as a torque in the same rotational sense 49 as the rotor when under impact by the water stream. It is so disposed and arranged that when the rotor vanes are submerged, the float will provide a buoyant force at least equal to that which is lost from the vane or vanes.

The float 50 may be as simple as a hollow block 51 of stiff lightweight material or foam fixed to lever arm 52. It is useful for the block to be supported so as to be rotatable on the arm, thereby better to withstand vigorous hydraulic forces. If preferred, tubes, even hollow tubes, may be used for this purpose. Whatever the situation, its position will be on the opposite side of pivot 38 so its torque will be in the same sense 49 as that of the vane. Clearly its weight should be such that it does not appreciably adversely resist the torque applied by the water stream.

Figure 2:
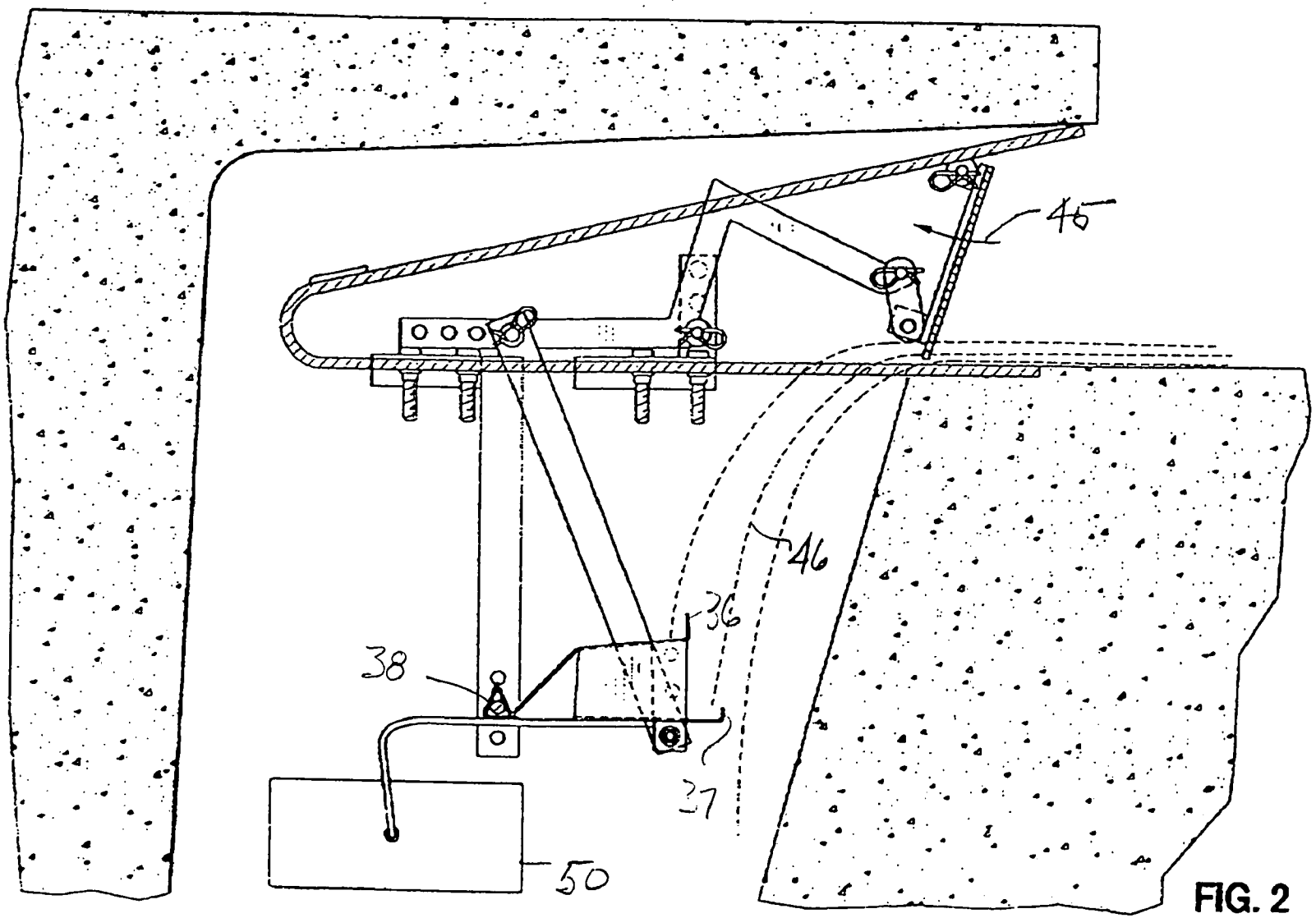
FIG. 2 is a view similar to FIG. 1 in which the gate starts to open as the consequence of a higher rate of flow.
Figure 3:
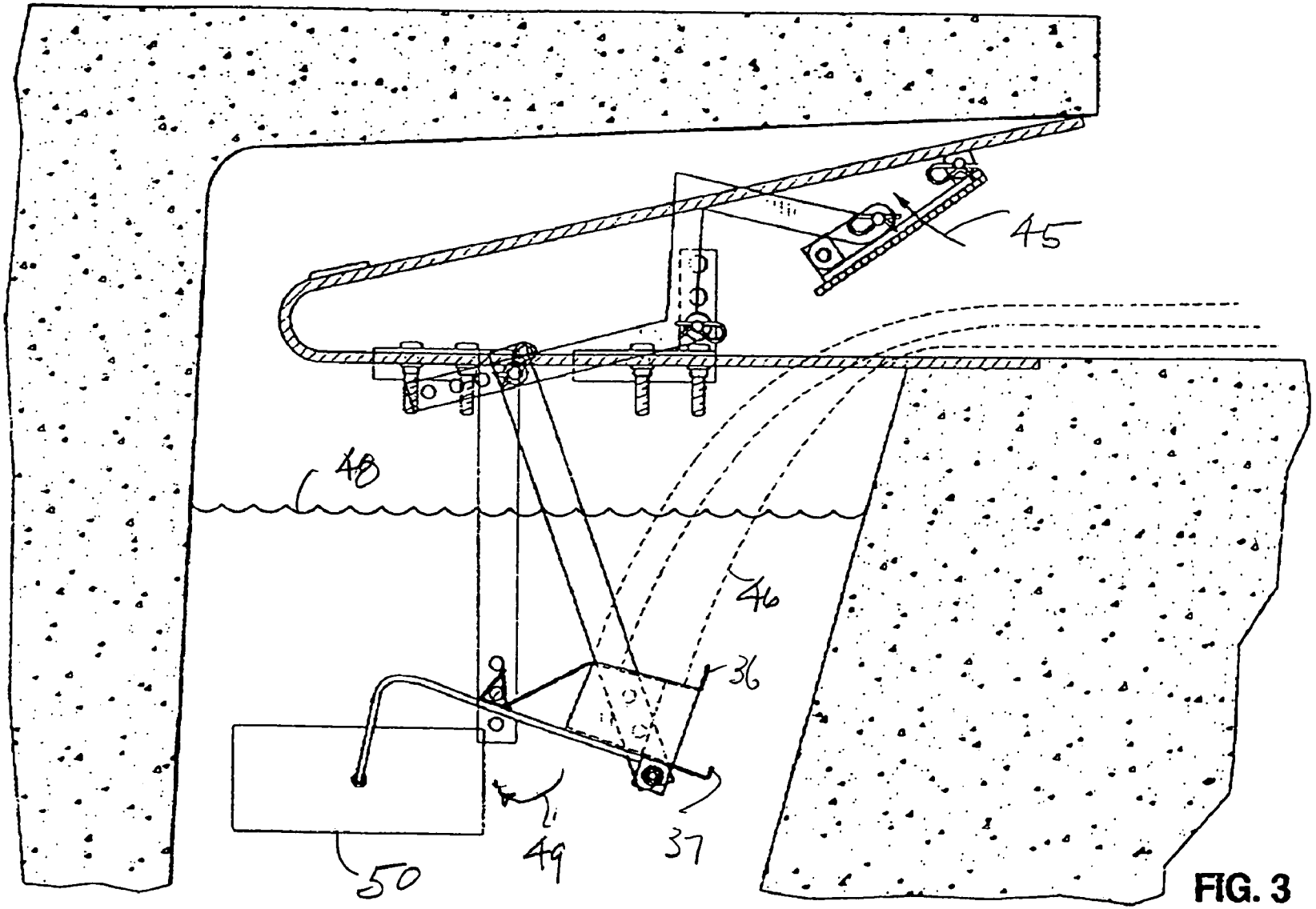
FIG. 3 is a view similar to FIG. 1 in which the gate is fully opened during rapid flow.
Figure 5:
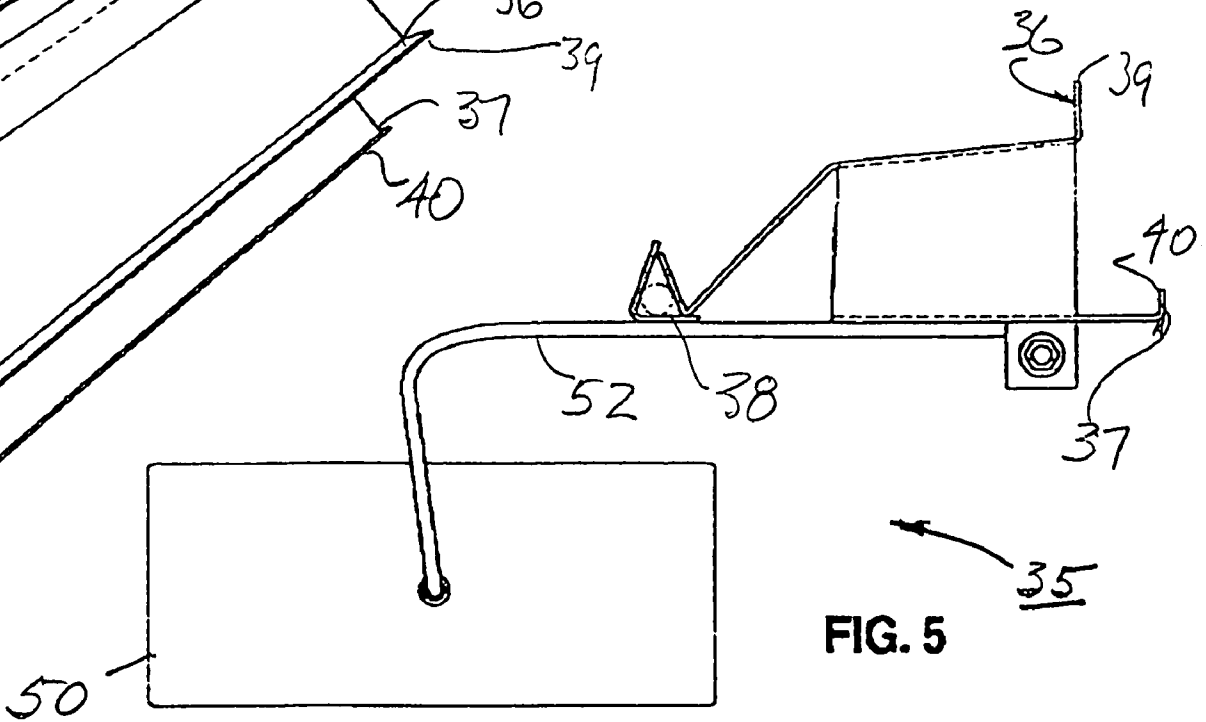
FIG. 5 is a side view of the actuator of FIG. 4.

FIGS. 1–3 illustrate normal operations with the water level in the basin (if any), below the rotor. In FIG. 3, line 48 represents a flooded level of water in the basin. Notice that the system will have remained open. The vanes are useless, but the submerged float exerts a torque to hold the system open by reason of its buoyancy.

This invention thereby provides a system to hold a drain system opening in its closed position at slow and no flow, and to open the system at high rates of flow, and to keep it open even if the system itself becomes flooded.

This invention is not to be limited by the embodiment shown in the drawings and described in the description, which is given by way of example and not of limitation, but only in accordance with the scope of the appended claims.

The invention claimed is:

1. An actuator to control the position of a pivoted gate in a curb opening entering into a drainage basin, the opening having a sill, a top and sides, the gate permitting passage while closed only of water flowing at a low flow rate, thereby restraining debris, said gate being pivotable to an open position when water is flowing at a suitably high flow rate thereby to pass both water and accompanying debris, there being a linkage in the basin linked to said gate, said actuator comprising:

a rotor having a fixed axis of rotation and a vane receptive of water from said opening flowing at a suitably high rate, said rotor being connected to said linkage in such manner that a sufficient force on said vane from said water at said suitably high flow rate will cause the rotor to rotate in a rotational sense and cause the linkage to rotate the gate to open; and a buoyant float connected as a lever to said rotor relative to said axis of rotation such that a buoyant force on said float will exert a torque on said rotor in the same rotational sense as is exerted by the vane as the consequence of water impact on said vane which opens the gate, whereby to maintain the gate open when the gate has been opened by the rotor, if the rotor then becomes flooded by accumulated water in the basin.

2. An actuator according to claim 1 in which a pair of said vanes is included in said rotor, angularly spaced from one another, each vane having a lip, and each vane being open to drainage.

3. In combination:

a drainage basin having a curb opening into it, said opening having a sill, a top and sides;

a pivoted gate in said opening openable to full flow and closed to permit by-passing of water at a slow rate but to exclude debris;

a linkage in said basin linked to said gate to move the gate between its open and closed positions; and an actuator comprising:

a rotor having a fixed axis of rotation and a vane receptive of water from said opening flowing at a suitably high rate, said rotor being connected to said linkage in such a manner that a sufficient force on said vane from said water at said suitably high flow rate will cause the rotor to rotate in a rotational sense and cause the linkage to rotate the gate to open, and a buoyant float connected as a lever to said rotor relative to said axis of rotation such that a buoyant force on said float will exert a torque on said rotor in the same rotational sense as is exerted by the vane as the consequence of water impact on said vane which opens the gate, whereby to maintain the gate open when the gate has been opened by the rotor, if the rotor then becomes flooded by accumulated water in the basin.

4. A combination according to claim 3 in which a pair of said vanes, is included in said rotor, angularly spaced from one another, each vane having a lip, and each vane being open to drainage from its sides.

* * * * *